US006752723B2

(12) United States Patent
Cullen

(10) Patent No.: US 6,752,723 B2
(45) Date of Patent: Jun. 22, 2004

(54) AIM VISUALIZATION, ANTI-TORQUE STABILIZED, AND RESONANT-STRUCTURED GOLF PUTTER HEAD

(76) Inventor: Hugh Leo Cullen, 1915 Montecito Ave., Suite 5, Mt. View, CA (US) 94043

( * ) Notice: Subject to any disclaimer, the term of this patent is extended or adjusted under 35 U.S.C. 154(b) by 17 days.

(21) Appl. No.: 10/062,224

(22) Filed: Jan. 30, 2002

(65) Prior Publication Data

US 2003/0144075 A1 Jul. 31, 2003

(51) Int. Cl.[7] ..... A63B 69/36; A63B 53/04

(52) U.S. Cl. ..... 473/251; 473/252; 473/340; 473/349; 473/313

(58) Field of Search ..... D21/736, 737, D21/738, 739, 740, 741, 742, 743, 744, 745, 746; 473/324, 340, 341, 251, 255, 349, 313, 252

(56) References Cited

U.S. PATENT DOCUMENTS

| | | | | | |
|---|---|---|---|---|---|
| D58,209 | S | * | 6/1921 | Bacheller | D21/745 |
| 1,654,916 | A | * | 1/1928 | Boyce | 473/249 |
| 2,222,534 | A | * | 11/1940 | Harris | 473/248 |
| D229,844 | S | * | 1/1974 | Pavelle | D21/741 |
| D231,373 | S | * | 4/1974 | Pavelle | D21/738 |
| D234,962 | S | * | 4/1975 | Swash | D21/739 |
| D235,668 | S | * | 7/1975 | Swash | D21/739 |
| 4,010,958 | A | * | 3/1977 | Long | 473/341 |
| D294,511 | S | * | 3/1988 | Durket | D21/742 |
| 4,979,744 | A | * | 12/1990 | Alcala | 473/341 |
| D316,129 | S | * | 4/1991 | Bryson | D21/739 |
| D337,803 | S | * | 7/1993 | Sillers | D21/741 |
| D339,181 | S | * | 9/1993 | Grim, Jr. | D21/738 |
| 5,344,151 | A | * | 9/1994 | Anderson et al. | 473/337 |
| D355,462 | S | * | 2/1995 | Wyatt | D21/741 |
| D355,944 | S | * | 2/1995 | Bendo | D21/741 |
| D356,846 | S | * | 3/1995 | Murrill | D21/741 |
| 5,417,429 | A | * | 5/1995 | Strand | 473/251 |
| D360,670 | S | * | 7/1995 | Nilsson | D21/741 |
| D372,752 | S | * | 8/1996 | Raudman | D21/744 |
| D380,801 | S | * | 7/1997 | Steele | D21/744 |
| D382,613 | S | * | 8/1997 | Devendorf | D21/739 |
| D387,404 | S | * | 12/1997 | Tylisz | D21/742 |
| 5,700,207 | A | * | 12/1997 | Guthrie et al. | 473/313 |
| 5,716,290 | A | * | 2/1998 | Baker et al. | 473/313 |
| D391,612 | S | * | 3/1998 | Moore | D21/745 |
| 5,830,078 | A | * | 11/1998 | McMahan | 473/252 |
| D410,056 | S | * | 5/1999 | McMahan | D21/744 |
| 5,993,324 | A | * | 11/1999 | Gammil | 473/251 |
| D437,017 | S | * | 1/2001 | Ford | D21/744 |
| 6,267,689 | B1 | * | 7/2001 | Ambrose | 473/251 |
| 6,350,208 | B1 | * | 2/2002 | Ford | 473/249 |
| D460,990 | S | * | 7/2002 | Jung | D21/736 |
| D461,515 | S | * | 8/2002 | Tang et al. | D21/742 |

* cited by examiner

*Primary Examiner*—Sebastiano Passaniti
(74) *Attorney, Agent, or Firm*—George S. Cole

(57) ABSTRACT

An improved golf putter head incorporates multiple perspective sighting and visualization elements, including multiple parallel alignment edges, striking vector sighting guides, multiple triangulation elements for equating a perspective 'vanishing point' with the desired break point to accurately gauge the striking vector's length, into a head engineered to distribute the mass distally outward along the Y axis from the central striking element in a 4:1 ratio to create anti-torque stabilization, and with the mass distributed rearward along the X axis for enhanced dynamic feedback during the backswing and enhanced dynamic stability, using connections amongst the mass elements whose shape, material, and placement provides improved resonance to improve the kinesthetic feedback, with a connection limitation to the shaft that best assures against torque during the swing by connecting the shaft vector through the rotational striking center of balance of the putter, thereby providing means for accurate stroke alignment, stroke triangulation, stroke power estimation, strike alignment, and stroking alignment of the putter.

16 Claims, 16 Drawing Sheets

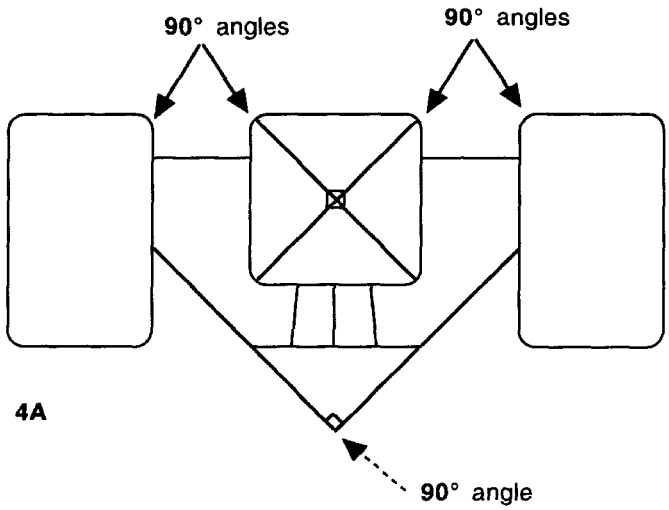
Figure 4A
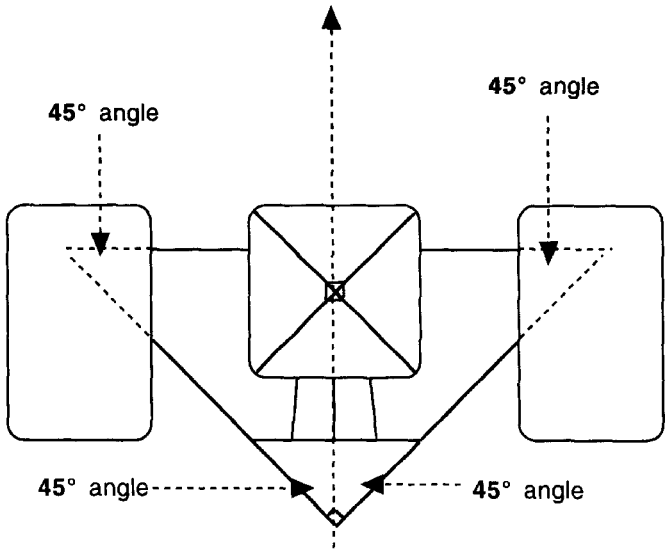
Figure 4B
Figure 4

Top View

Side View

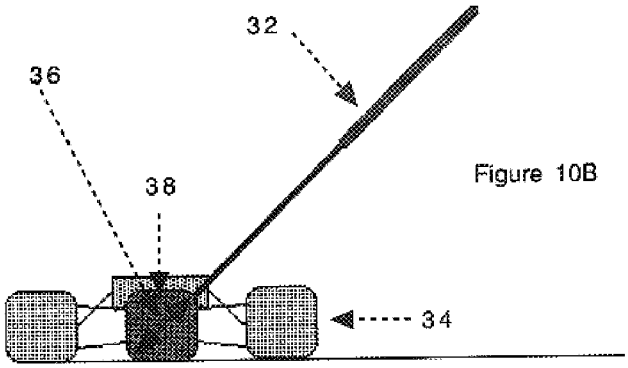
Figure 10B
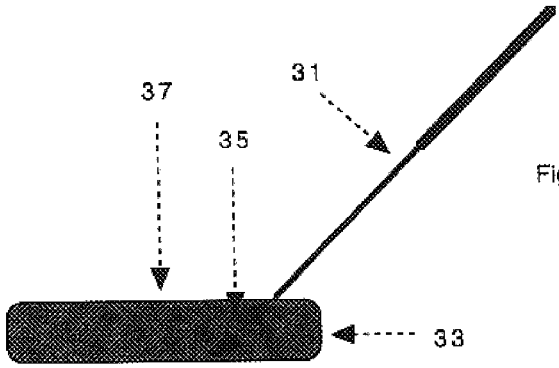
Figure 10A
Figure 10

AIM VISUALIZATION, ANTI-TORQUE STABILIZED, AND RESONANT-STRUCTURED GOLF PUTTER HEAD

BACKGROUND OF THE INVENTION

1. Field of the Invention

The invention relates to a golf club, more particularly to a putter, and most particularly to a putter head and its attachment to the rest of the putter, that assists a golfer to meet the requirements and challenges of accurate putting.

2. Description of the Related Art

A golfer wants to sink the ball into the hole in as few shots as possible. A golfer's goal, when putting, is typically to sink the ball with a single, and preferably straight, putt. Most golf clubs are used to drive the ball from the tee to the green. The putter is then used to stroke the ball into the hole in the green. In golf, the putter is the club where accuracy is more important than range, and its use accounts for some 40 percent of score, which is twice as much as the second most often used club, the driver. Good putting involves a complex mixture of static and dynamic aspects of human-factor, visualization, and structural/kinesthetic elements. A flaw of prior inventions in this field is that each addressed only a portion of what accurate putting requires.

DEFINITIONS

'Shaft' 'head' and 'putter' use the definitions stated by the USGA, Appendix II.

A putter includes a shaft with a gripping handle end and a head end. A putter head is fixedly attached to the head end of the shaft.

The 'striking direction' is a line parallel to the ground and identical to the initial straight line of the intended shot.

The 'break point' is the point along the striking direction where either the ball goes in the hole, or the ground will force a change in the vector so ball will go in the hole, or at least come as close to the hole as is possible. After the putt reaches the break point, if it does not go in, the changes in the putt's vector depend upon the external conditions, especially curvature, of the surface over which it travels.

The 'strike vector' is that sub-part of the striking direction that extends from the golf ball to the break point; and its length is a critical as its direction.

The 'X-Y' plane is a two-dimensional plane where the X axis is parallel to the striking direction at the moment of impact between the putter and the golf ball and extends from the back to the front of the putter head, and the Y axis is perpendicular to the striking direction and extends from the left to the right of the putter head.

The 'ground plane' is a two-dimensional plane with X and Y axes parallel to the ground where the X axis is parallel with, and the Y axis is perpendicular to, the striking direction. Generally, the X-Y and ground planes will be identical when putting.

The 'strike plane' is a two-dimensional plane with Y and Z axes that is perpendicular to the ground plane and to the striking direction.

The 'loft plane' is a two-dimensional plane with X and Z axes that is perpendicular to the ground plane and parallel to the striking direction.

The 'striking face' is the portion of the putter head that is designed to strike the golf ball. (Putters, under USGA rules, may have two strike faces, but only one may be operative for any given putt.) There may be both a theoretical striking face and an actual striking face; the former is perfectly parallel with the striking plane throughout the striking face and matches the golfer's visualization of the putter, while the actual striking face will have a 'strike line' (a line on the striking face at the furthest forward point on the X axis, which extends along the Y axis) which is parallel with the striking plane, but otherwise be inclined from the theoretical striking face (i.e. deviate from a 90° perpendicular to the ground plane), even though the degree of inclination may be imperceptible to the putter and not part of his visualization when putting.

The 'rotational axis of the putter' is the line extending from the putter shaft through the putter head. The shape of the parts actually connecting the shaft and the head may deviate from this line; it is the line of effect for rotation in the X-Y plane.

The 'rotational center of balance' is the point in the putter head where an equal torque in the X-Y plane will rotate the putter equally clockwise or counterclockwise.

The 'rotational striking center of balance' is the point in the strike plane on the line through the putter head that divides the mass of the putter head equally along the Y axis.

"Rotationally balanced" means that a putter, when laid across the palm of the hand in such fashion that it does not tip down and with the strike face oriented parallel to the ground, remains in that position until disturbed, and will rotate clockwise and counterclockwise around the shaft (and thus, during a putt, in the ground plane) an equal degree for an equal amount of torque in the X-Y plane applied to either head or shaft.

'Stroke alignment' is alignment of the putter head with the striking direction such that the theoretical striking face matches the strike plane and is centered on the striking direction.

'Stroke triangulation' is accurately measuring the strike vector, i.e. how far the putt will travel before reaching the break point (and as is desired in most cases, going into the hole).

'Stroke power estimation' is deducing the power necessary yet only sufficient to cause the ball to traverse the strike vector, no more and no less.

'Strike alignment' is precision in the initial strike as to both alignment and power, such that the (dynamic) performance matches the (prior, static) visualization.

'Stroking alignment' is continued alignment of the motion of the center of the striking face along the striking direction during the follow-through.

Together, stroke alignment, stroke triangulation, stroke power estimation, strike alignment, and stroking alignment, determine a putt's accuracy.

The 'sweet spot' means that area on a putter head's striking face which should come into contact with a golf ball to give the optimal strike alignment and maximize kinesthetic feedback to the golfer (the latter also being known as 'the best handling feeling').

Successful Putting Requirements

The first and usually first-considered requirement in putting is that the golfer visualize the striking direction accurately. The best putt made, which was ill-aimed, is flawed. Even when conditions dictate that the ball, to go into the hole, must 'break' from a straight line and follow the path dictated by those conditions [e.g. curving with the slope(s) of the green], the initial portion of virtually all strokes will be a straight shot along the strike vector.

Stroke alignment, which must precede each putt, requires a golfer to visualize a line from the center of the putter head that (1) is perpendicular to the theoretical striking face of the putter (a flat surface), (2) passes through the center of the golf ball (a spherical surface), and (3) passes through the break point (or hole). The design of a putter, particularly of a putter's head, can greatly affect a putter's ability to meet these requirements and challenges for accurate putting. Other patent applications for putter heads have used visual markings as the means for providing sighting aids to assist a golfer; most failed to consider, let alone use, the visualization properties of the putter head as a whole, and the rest only partially used the head's structure and design.

Second and third, and subtler, requirements for any putt, that involve more expertise and skill, are that the golfer first correctly estimate the length of the strike vector, that is, the travel distance the putt must move along the striking direction to reach but not overshoot the break point, and then determine the correct power to put into that stroke. Stroke triangulation and stroke power estimation have been generally ignored by the prior art. Yet while inexperienced and moderately competent putters struggle with stroke alignment, more experienced and professional putters become far more concerned with stroke triangulation and stroke power estimation. Accurately estimating the distance between the ball and the break point involves two-dimensional visualization of the ground plane and translation of the three-dimensional cues concerning distance into a two-dimensional strike vector. Stroke power estimation requires accurately gauging the nature of the intervening surface (curved, wet, dry, thick, slick, slow, or fast) and the effect it will have on the stroke, which improves with experience only to the extent the putter provides proper feedback to the golfer from previous putts (successful or not).

Several inventions have addressed the first requirement by providing assistance for visualizing the striking direction. Most prior inventions focused solely on linear alignment. (U.S. Pat. No. 5,993,324, Gammil, A., identified other prior art featuring alignment aids.) The most common approach was perpendicular squaring, and the more effective art, that of multiple, parallel squaring. These are different approaches to 'perspective boxing' (forming multiple parallel lines which will fall on either side of the striking vector and pass on either side of the hole); but Gammil's approach, like those cited therein, all fail to provide means to address the second and third requirements. As any putter knows who has watched his putts fall short of, or bounce over, the hole, alignment may be necessary, but it is not sufficient for truly accurate putting.

After visualizing the putt (the static aspect of the skill), the golfer must perform the putt (the dynamic aspect of the skill). The putter is swung back, forward to impact the ball, and then through the ball's initial position; these are the backswing, foreswing, and follow-through. Each must be properly performed for a perfect putt.

The fourth requirement for an accurate putt therefore is that the putter strike the ball correctly, which involves a number of included sub-requirements. The golfer must visualize and produce, dynamically, the precise, and preferably perpendicular, tangent between the spherical form of the ball and theoretical striking face at the moment of impact. For all but the shortest of strokes, the break point will be out of the golfer's sight picture at that moment (golfers look at the ball, not at the break point, when they are putting). As multiple parallel lines extend into infinity without changing, estimating distance at that moment is an unsolved dilemma in the prior art. A golfer must focus, but not fixate, on the strike; too tight a grip, or too over controlled a swing, are just as bad as too loose a grip or uncaring a swing. The initial strike must be precise both in the alignment of the striking surface of the putter head as it encounters the ball, so the ball will not move across the putting green at an unintended angle or with a surprise hop or skid, and in its power, so the ball will neither undershoot nor overshoot the hole. The swing must align with the striking direction to avoid unintended spin, and with the ground plane to avoid fouling the ground or causing undesired loft, top-spin, or backspin, which will interfere with the ball's travel along the strike vector.

Two of the most common problems in strike (and stroking) alignment arise from minute, unintended or unperceived rotations of the striking face in the ground plane. If the rotation is clockwise (from a viewpoint looking down at the ground, for a right-handed golfer), the ball will veer off to the right (or 'slice'); if the rotation is counterclockwise, the ball will veer off to the left (or 'hook'). Stroke alignment requires a distant and static perspective which includes the both the 'start point' and the 'end point' of the intended line; but strike alignment requires a near and dynamic perspective, which concentrates on the 'start point' where the impact occurs; while stroking alignment shifts back to a distant yet dynamic perspective which includes the break point. Prior art fails to consider that a putter head's design should and could support each of these differing needs.

Other common problems with strike and stroking alignment include (1) moving the putter head along the Y axis while striking through the X axis, which can put undesired spin or 'English' on the ball when it is struck; (2) moving the putter head through the loft plane such that it contacts the ground and fouls strike or stroking alignment; or, (3) moving the putter head through the loft plane unnecessarily, dampening kinesthetic feedback. Any twist in the putter head in the X-Y plane during the swing (back, fore, and follow-through) creates torque and inclines the striking face from the perpendicular to the striking vector. Any of these will create an off-line shot, that is, one which will deviate from the striking vector. In addition, if the putter strikes the ball on either side of the rotational striking center of balance, the putt creates torque when the striking face hits the golf ball, which will tend to twist the putter head from the perpendicular and thus impart an off-line shot. All of these are problems of strike alignment during the backswing and foreswing, and stroking alignment during the follow-through.

Stroke alignment, strike alignment, and stroking alignment must be identical for the shot to be accurate. They will not suffice—the length of the putt, the stroke power, is also critical—but if they differ, the putt must go wrong. Matching performance to visualization (generally) improves with experience, especially if the putter provides good feedback that permits the golfer's kinesthetic sense to match which his visualization.

(Positive emotional feedback, while desirable and intended, is beyond any guaranteed reach of this application. The most choosy and perfectionist golfers can never be satisfied. The applicant cannot and does not promise that putting better will make any golfer happier, richer, or more admired.)

Developing the experience and awareness of the proper feel for each putt, maximizing the positive kinesthetic feedback from each putt, is one of the challenges and delights in golf. It is well understood in the sport that the "feel" of a club as transmitted to the golfer's hands is important for control and accuracy. Various patents and applications have considered different materials, different masses, or different mass distributions, yet have not considered a design approach for the clubhead which promotes such feel irrespective of the material, mass, or distribution by differentiating the response during strike alignment and stroking alignment, or by structure that promotes resonance keyed to human factors and expectations.

Golfers rarely intend for putts to have any motion in the loft plane; they want to avoid having the putter head contact the ground during the putt, including the follow-through, as this generally spoils the stroke.

In conventional and prior designs, the mass of the head is so distributed that the sweet spot is not as wide as the striking face, which makes it more difficult for golfers to make the sweet spot contact the ball. Missing the sweet spot usually causes the ball to travel a considerably lesser distance, and often contributes to the tendency to "push" or "pull" the ball (to the right or left, respectively); or, in other words, to create problems with both stroke and stroking alignment. It also decreases the kinesthetic feedback from that putt.

Techniques to broaden the sweet spot generally provide a means to concentrate the weight of the club head in the heel and the toe rather than directly behind the sweet spot. In one particular design, the head is fabricated of a relatively light material and inserts of denser material are provided in the area of the heel and toe of the club head. In another design, the portion of the club head directly behind the club's ball-striking face is removed so that the weight is necessarily located in other portions of the head, namely the toe and heel portions. While in both of these designs the sweet spot is indeed broadened, they disturb strike alignment as the striking face of each of these clubs lacks the stiffness needed to advantageously utilize the elastic energy generated in the golf ball. This stiffness is needed in order to preclude any deformation of the face, under impact, that would tend to increase the area of contact between the face of the ball and thus dissipate energy in the club head instead of imparting it to the ball. Moreover, they disturb stroking alignment to the extent that they cause problems with rotational striking center of balance, and thus the effective sweet spot, if not done correctly. Distribution of the mass alone fails to consider the interactions between and amongst the different elements of the putter head, which interaction ineluctably becomes part of the feedback. Furthermore, such distortions do not provide resonance. While golfers have long talked about the 'feel' of a club, prior inventions have paid little attention to engineering designed to improve that aspect. The golfing world and even several patents may have discussed 'the sweet spot' of a putter, but the prior art does not include design aspects which deliberately foster a better sweet spot for a given amount of mass by focusing on the interaction between and amongst subordinate elements of the putter head.

The fifth requirement for an accurate putt is that the putter continue to move along the correct striking line for the short period after the initial strike when the ball may re-encounter the putter, and at least during that (preferably short) period when the ball is in contact with the putter. The ability to produce the right direction and amount of 'follow through' depends upon proper feel for both the putter and the moment of contact during the stroke. Thus, a golfer must perform 'stroking alignment', during the follow-through phase immediately after the moment of initial contact, for each putt. If the stroke does not follow the strike line, the putter may impart unintentional spin or 'English' to the ball, which will throw a curve into the planned shot.

Designing a putter to meet all of the above requirements, while staying within the formal USGA and 'match play' restrictions, has led to a fair amount of prior art. Most of these inventions, however, focus on only one of the above requirements and thus fail to meet the advances taught in the present invention.

Prior Art Teachings and Differences

In U.S. Pat. No. 4,227,694, Drake, R., an 'aim-assisting' linear element is included as an element on the shaft, which throws off the rotational center of balance for the putter.

U.S. Pat. No. 4,253,667, Clark et. al., attempts to provide a better 'sweet spot' by using an H-shaped design to spread it laterally; but fails to consider elements essential to strike alignment, resonance, and stroking alignment; in fact, that invention's convex bottom shape makes stroking alignment more rather than less difficult, since the purpose of that element is to make the same putter work equally well for different players.

U.S. Pat. No. 4,265,451, Bernhardt, F., uses another 'sighting line' approach that modifies the shaft by including a weighted neck member, without regard to its negative effects on the striking and stroking alignment, feedback, or sweet spot.

U.S. Pat. No. 4,369,974, Komperda, J., teaches the use of transparent or translucent material to provide internal sighting lines, and considers the concept of parallel lines to 'match' the striking direction, but provides no means for ready estimation of the distance of the striking vector.

U.S. Pat. No. 5,209,474, Voyer, P. teaches the use of an elongated shaft; U.S. Pat. No. 5,595,385, Jablonski, T. teaches use of a multi-sectional shaft with a anti-rotational handle (a design which violates the restrictions in the USGA rules); and U.S. Pat. No. 5,632,691, Hannon, et. al. Teach specific design limitations to the shaft; none of these address putter head design.

U.S. Pat. No. 5,993,324, Gammil, A. evaluates much of the prior art concerning strike alignment, and produces a design which addressed issues therein as well as providing means for customization. (USGA rules specifically prohibit modification of a club during a round, limiting the desirability of this feature.) This patent is discussed in further detail below, as there are other aspects where the present invention differs significantly that were unaddressed, or inapt, in Gammil's work.

U.S. Pat. No. 6,190,266, Pamias, F. and the many patents cited therein, also relate to the design of the shaft(s) or handle(s) of a golf putter; the former does state a specific set of principles governing their attachment to the putter head, but otherwise these do not address putter head design.

U.S. Pat. No. 6,200,226, Regan, K., integrates a ball mark assembly in the putter head; U.S. Pat. No. 6,234,915, Wu, K. requires an anti-shock slat or neck; and U.S. Pat. No. 6,244,974, Hanberry, Jr., E., requires obtuse angles and quintuple faces on the putter head, all elements missing from and irrelevant to the present invention.

U.S. Pat. No. 6,200,227, Sery, J., does not include means for stroke alignment, strike alignment, and striking alignment, nor address dynamic as well as static concerns with accurate putting. Additionally, that patent is designed to position the golfer's head and eyes to a particular fixed point, above the center of gravity of the putter, rather than improving the putt independent of the plane of position of the golfer's head.

U.S. Pat. No. 6,203,443, Britton, R. least considered the problem that visual markings on a putter, particularly on the club head, fail in themselves to provide proper sight lines, as they are not perpendicular to the face of the putter but only perpendicular to a vertical plane. However, that invention used variable loft or variable weight as the means to address this problem. Also, providing sighting aids to achieve correct alignment and optimum aim addresses only the problem of stroke alignment, and thus this patent did not address the problems of striking and stroking alignment. That patent conceded that using lines alone is unsatisfactory, "Because these sight lines too are generally not perpendicular to the striking face, the golfer has two parallel sets of sight lines to look at, neither of which are perpendicular to the striking face."

U.S. Pat. No. 6,203,445, Rhodes, B. et. al., also considered only the element of stroke alignment and incorporated a second alignment face in the head, an element not required in the present invention.

U.S. Pat. No. 6,213,890, Prince, R., hypothesized that the area of the "sweet spot" is directly proportional to the mass of the head of the instant putter, then used a crude approach of simply increasing the mass of the head. (In engineering, this common and simplistic approach to a solution is known as 'using a bigger hammer'.) Though the invention discusses some physical principles, and a good amount of the prior art, it failed to consider further application of engineering to attain superior performance for a given or equal mass by intelligent distribution and interconnection of sub-elements.

U.S. Pat. No. 6,251,027, Buchanan, D., teaches a different design to the shaft to improve the 'feel' of the putter. And U.S. Pat. No. 6,234,915, Wu, K. teaches the use of an anti-shock slat in the neck. Both incorporate elements not needed in and irrelevant to the present invention.

U.S. Pat. No. 6,244,974, Hanberry, E., returns to the sighting alignment problem with by providing a plurality of azimuthal sighting lines and multiple faces to the putter, pressing dangerously close to violating the USGA rules thereby. All that is taught, however, is 'sighting lines'; none of the problems of stroke triangulation, striking alignment, or stroking alignment are addressed.

U.S. Pat. No. 6,251,026, Bonvillain, J., modifies the shaft to allow for not just one, not just two, but three possible sighting alignment means, leading to speculation as to which problem the inventor considered to be his worst . . . and including multiple elements neither necessary nor relevant to the present invention.

U.S. Pat. No. 6,261,190, Ashcraft, D. teaches sight alignment means which use separation of an embedded alignment figure to indicate disorientation . . . without, however, including means to produce the initial, correct alignment with the striking direction. That, one supposes, just happens fortuitously or through the skill of the golfer.

U.S. Pat. No. 6,264,571 teaches means to dynamically balance a putter by modifying the alignment between the putter head and shaft through a sliding hosel, an element not used and a concern not addressed in the current invention.

U.S. Pat. No. 6,267,689, Ambrose, J. teaches modification of the putter head to redistribute the center of mass thereof and uses a generally triangular shape to the whole head, without considering the concerns of stroke triangulation, striking alignment and striking alignment, although it uses the shaft to control aspects of the problem of stroke alignment. However, the core of this invention is the concentration of the putter head mass in the upper half, mass differentiation along the vertical plane, which is not an element nor a concern of the present invention.

U.S. Pat. No. 6,267,690, Salmon, M. teaches a reasonable method to improve the putt by incorporating a curved configuration to the striking face, which unfortunately violates the USGA rule requirement that the club face "shall not have any degree of concavity". Moreover, the design of that invention is intended to impart spin or backspin to the ball, one of the problems the current invention seeks to obviate or correct.

U.S. Pat. No. 6,270,422, Fisher, D. incorporates a trailing member, or trailing members, but does so irregardless of the effect on either the stroking alignment or the dynamics of the sweet spot. And, while that invention teaches that the trailing member may be a triangle, the considerations of the fit, spacing, alignment and connection between the trailing member(s) and the striking element that assist with the stroke alignment (particularly the distance element), striking alignment, and stroking alignment are not taught nor disclosed, let alone discussed therein. That inventor, however, did state correctly that "a large polar moment of inertia is desirable because it resists any tendency of a golfer to twist the club shaft as it is swung forward to impact a ball", thereby at least recognizing one aspect of the problem of striking alignment. The patents disclosed therein, and incorporated by reference herewith, did not, as Fisher points out, address the striking alignment problem. The chief purpose of Fisher's teaching, however, was to balance the heel-and-toe elements of the polar inertia by use of the trailing member(s), which problem the present invention solves in a different and simpler fashion, without requiring differential or adjustable weighting. Also, while Fisher talks of 'framing lines' for the stroke alignment problem, he fails to consider means to create more than mere polar inertia resistance.

Many other patents address elements, aspects, or concerns which are disparate from the present invention. In U.S. Pat. No. 6,273,827, Hockerson, S. teaches use of a resilient ball-striking pad on the striking element, an aspect and element not considered nor used in the present invention. U.S. Pat. No. 6,280,346, Gedeon, R. teaches the use of a mallet head, and focuses on the design of shaft, grip, and their interconnections, which are also not relevant to the present invention. And in U.S. Pat. No. 6,283,874, Studebaker, J. focuses on shaft design, a concern distinct from any aspect of the present invention. Finally, in U.S. Pat. No. 6,283,875, Jones, D. teaches the use of a support implement using paired leg members to stand a club up. All of these include concerns, elements, and aspects neither necessary nor relevant to the present invention.

SUMMARY OF THE INVENTION

By connecting the shaft such that the rotational axis of the putter passes through the rotational striking center of balance, distributing the mass of the putter head outward from the rotational center of balance and with a rearward bias along the X axis, incorporating sub-elements of the putter head that enable parallel and reflexive triangulation, using energy-reflective and transmissive connections amongst the sub-elements, and shaping each sub-element and their combination in accordance with human-factor visualization, focusing, and kinesthetic principles, an improved golf putter is created that enhances the golfer's ability to perform stroke alignment, stroke triangulation, stroke power estimation, striking alignment, and stroking alignment, and thereby to putt better.

BRIEF DESCRIPTION OF THE DRAWINGS

FIGS. 4A and 4B are is an abstraction of the putter head, from the top view, showing the visualization angles incorporated in the design.

FIGS. 10A and 10B contrast the present invention (FIG. 10A) and prior art (FIG. 10B) approach to connecting the shaft to the putter head, particularly as to the link with the rotational striking center of balance.

DETAILED DESCRIPTION

Figure 1:
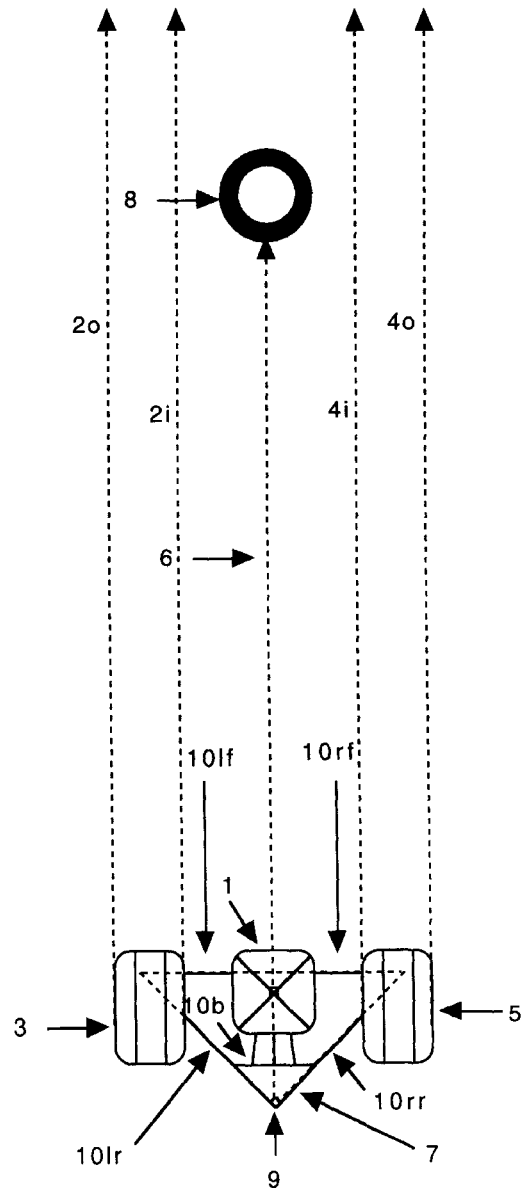
FIG. 1 is a view of multiple parallel sighting lines 'boxing in' the striking alignment.

A golf putter's striking face moves through a complex three-dimensional curve to impart a two-dimensional vector to the golf ball. That two-dimensional vector, the striking direction, intersects the break point. Most putts are straight shots, where the striking vector is identical with a line drawn between the ball and the hole. The striking face of the putter is first made perpendicular to the striking vector, and then the putter must move and be aligned perpendicular to the striking vector at the moment of impact and afterwards. None of the prior art address all of the requirements identified above for accurate and easy stroke alignment, striking alignment, and stroking alignment, but the present invention does in novel and unexpected ways.

Stroke Alignment: A Parallel Line is not Enough

Means for merely providing linear alignment and aiding the golfer in sighting in a perpendicular placement are disclosed in the prior art. Single or multiple linear elements of the putter (shaft, head, or combination thereof) have been used to indicate the striking vector and assist the golfer with stoke alignment. The use of perspective and parallel boxing with rectilinear sighting aids is well known. The preferred embodiment of the present invention incorporates multiple, parallel lines in the left and right stabilizers and the central striking face, which are sub-elements of the putter head; and these parallel lines if extended both parallel and 'box in' the striking vector when the striking face is perpendicular to the striking vector. This meets the first requirement of stroke alignment and assists the golfer to visualize and set the strike vector.

Unlike most of the prior art, however, the preferred embodiment uses multiple parallel lines, which include pairings that are different and equivalent in distance from the striking vector. This can be seen in FIG. 1, which represents a simplified top view of the putter head, aligned perpendicularly to the striking vector (6) and the hole (8). A first inner set of lines is formed by the sides of the central striking element (1), though these are omitted from the diagram to avoid confusion. A second set (2*i* and 4*i*) are formed equidistant from the center by the inner sides of the left and right stabilizers (3 and 5). Third, fourth, and fifth sets are formed by the upper and outer facings of the stabilizers, which in the preferred embodiment are hexagonal, with the top facing parallel to the ground. Only the fifth, outermost set of lines (2*o* and 4*o*) is shown, again to avoid confusion.

A golfer who extends these lines in a visualization gains additional parallax when turning the striking face, as the break point will appear to move against the multiple extensions, an aid which is absent with only a single, linear visualization aid. The distance between the innermost and outermost set is differentiable from the distance between the set boxing in either stabilizer, which supports and enhances the parallax effect.

Stroke Triangulation: Even Multiple Parallel Lines are not Enough

Linear alignment of a stroke and knowledge of the proper striking direction is not enough for an accurate visualization of the strike vector; the latter's linear depth must also be resolved. As golfers grow more experienced, they recognize that the length of the strike vector, and thus the putt, is at least as important as proper orientation, or stroke alignment. To obtain the length of the strike vector the distance must first be measured, while the golfer looks from the golf ball to the break point, and then dynamically visualized and recreated, as the golfer looks at the golf ball when he is striking it. A putter should help by putting these tasks in the proper perspective. The present invention does so by first providing means for equating the break point with a 'vanishing point', thereby equating a psychological goal with a subconscious perceptual mechanism, and then providing means for reflexively reproducing the same vanishing point by dynamically recreating the correctly-angled perspective lines when putting through reflexive triangulation.

Perspective drawing, and visualization, uses artificial 'vanishing points' to create a horizon within a view and thereby represent three-dimensional distances within a two-dimensional plane. Linear perspective uses actual lines, suggested lines, or both together that intersect at a vanishing point to delimit distance. The preferred embodiment of the present invention helps the golfer visualize a putt by assisting in the creation of an artificial horizon for the X-Y plane that treats the break point as a vanishing point on that horizon. Doing so involves estimating the angles which form the 'perspective lines', first when visualizing the putt during stroke triangulation, and then again, when making the putt, during striking alignment.

Figure 2:
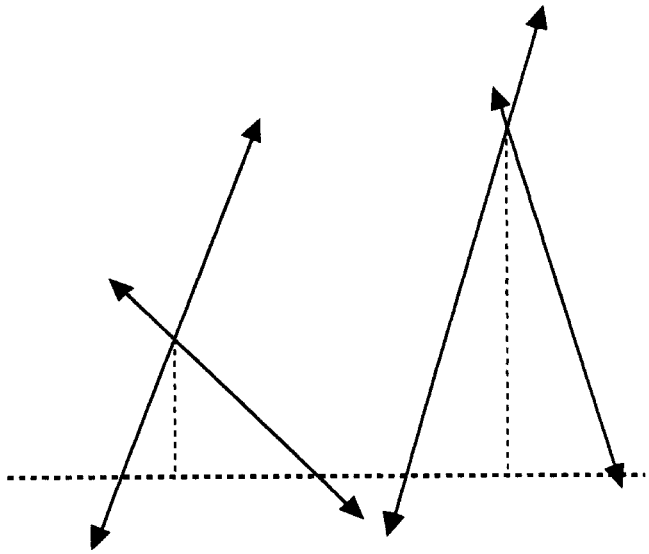
FIG. 2 is an abstraction of triangulation as a means for distance estimation.
Figure 3:
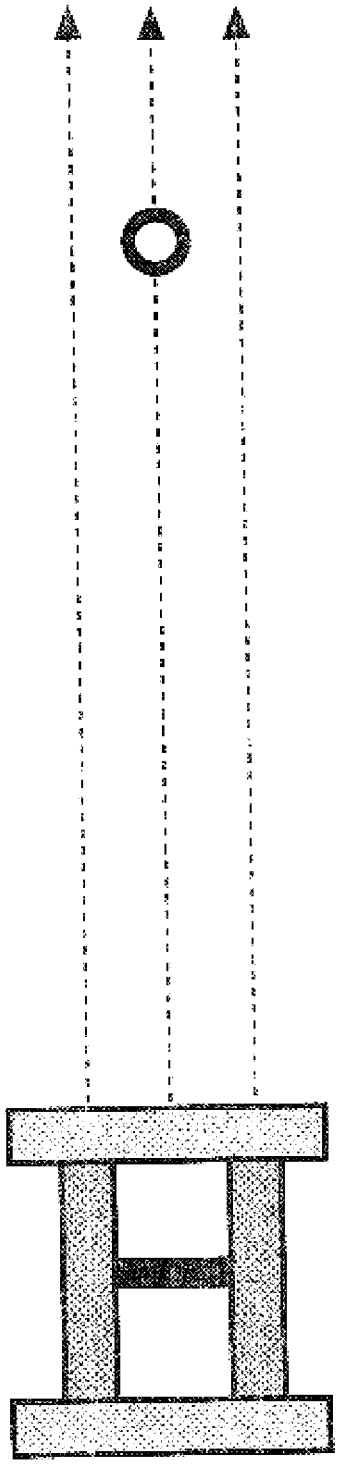
PRIOR ART Figure 3
FIG. 3 is an example of the prior art (Gammil) providing means for stroke alignment, but not for stroke triangulation or striking alignment.

Human culture, education, and experience teach triangulation as a means to measure distance. The intersection between two lines, each of which crosses a known baseline at a known distance, defines the perpendicular vector from that baseline to that intersection. (FIG. 2). Parallel lines, since they never meet, cannot create perspective and, if they are all or most of what a putter head provides, will tend to confuse and impede a third-dimensional visualization. (FIG. 3; representing prior art such as that found in U.S. Pat. No. 5,993,324, Gammil, A.) Lines and perpendiculars alone are not sufficient; lesser angles must also be provided for effective and realizable triangulation.

Triangulation requires both straight lines and non-perpendicular angles; preferably acute, or less than 90°, the right angle. (This is one time where only being right, is wrong.) Certain angles are 'preferred' as they are culturally familiar and more readily worked, the diagonal (45°) being foremost. Estimation in a visualization of an unknown angle is easier if both straight lines and known angles are provided; and is best done when both parallel lines and reflexive angles are available to provide comparisons and contrasts.

If more than one unknown angle is seen along a known line, and all such are related to a predefined perpendicularity, the estimation of any particular angle is easier, for the others narrow the range of estimates. Multiple, fixed narrowings also enable interpolated estimation by the simple mechanism of searching for the closest comparison. The multiple and differentiably separated sets of equidistant parallel lines incorporated in the preferred embodiment of the invention assist with such estimation, far more readily than single sets of parallel and equidistant parallel lines found in the prior art.

Figure 5:
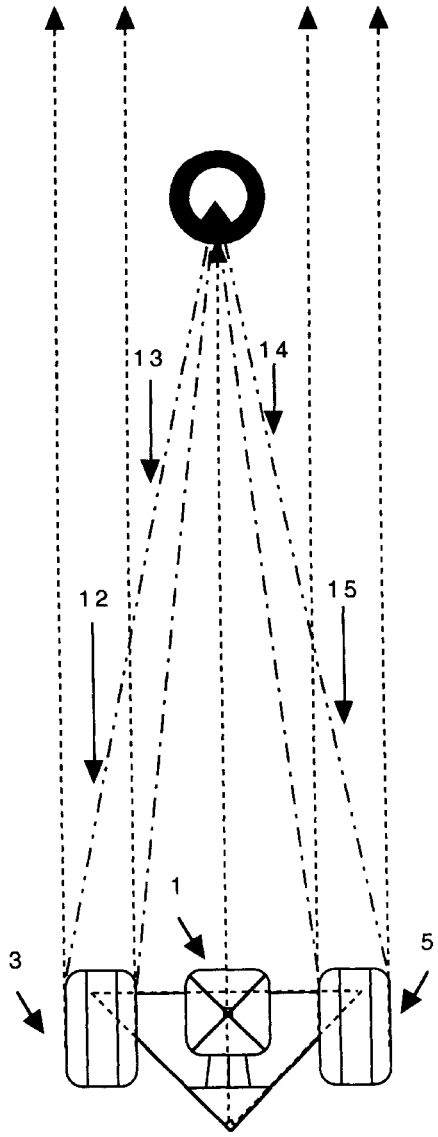
FIG. 5 is an abstraction of the stroke triangulation visualization lines from the putter head to the hole.

Also unlike the prior art, the preferred embodiment of the present invention incorporates both 90° and 45° angles, the former at the front comers of the central striking element and left and right stabilizers, and at the rearmost point of the rear element (FIG. 4A), and the latter at either side of the split of the rearmost point of the rear element by the striking vector, between the left forward and rear connecting links, between the right forward and rear connecting links, and necessarily and reflexively, between any line parallel to the striking face and a line parallel to either of the left or right rear connecting links. (FIG. 4B). These angles allow more accurate estimation of the intersecting sighting lines because they allow more accurate estimation of the angles of the perspective lines. (FIG. 5; Items 12, 13, 14, and 15).

Also unlike prior art the preferred embodiment of the present invention enables ready triangulation, and triangulation that is reflexive along both the X and Y axes, which enables static and dynamic visualization of the length of the striking vector, by incorporating trigonometric elements into its design that allow for both easier comparison of the sighting triangles and comparison of the near comer angles at the striking face.

Figure 6:
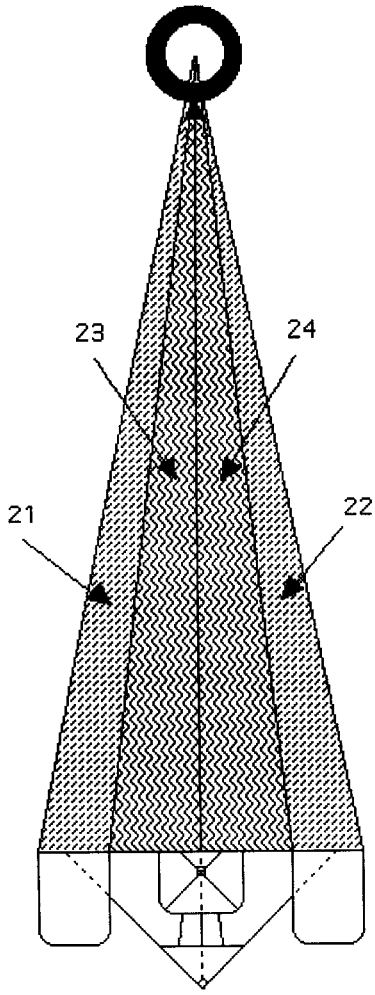
FIG. 6 is an example of the visualization triangulation with multiple forward triangles.

The left and right perspective lines (12 and 15, 13 and 14) will only intersect at the vanishing/break point when the striking vector is perpendicular to the center of the striking face of the putter. This condition holds if any of the same two triangles to the left and right of the striking direction, the sighting triangles (FIG. 6; 21 and 22, 23 and 24; 23 and 24 are included as part of 21 and 22, respectively) are equivalent.

Two triangles can be proven to be equivalent if any two sides and their connecting angle can be proven equivalent. Since the length of the striking direction to their intersection is shared, it will be the same for any pair of sighting triangles. The length of the lines along the striking plane between the center of the striking face and the near comer angles, for example, the inside edges of the stabilizers, will be equal, as the left and right stabilizers are of equal width and equidistant from the central striking element. Finally, the connecting angles between the striking direction and the striking plane to the left and right will be identical (90°, as they are perpendicular.) This much can be obtained by many approaches used in the prior art. However, this equivalence is also true for ALL perspective points along the striking direction, which makes this approach useless for triangulating distance of its sub-portion, the strike vector. If the golfer needs to estimate the length of the strike vector, he must use an approach which does not require its measurement as a prerequisite to the solution.

Figure 7:
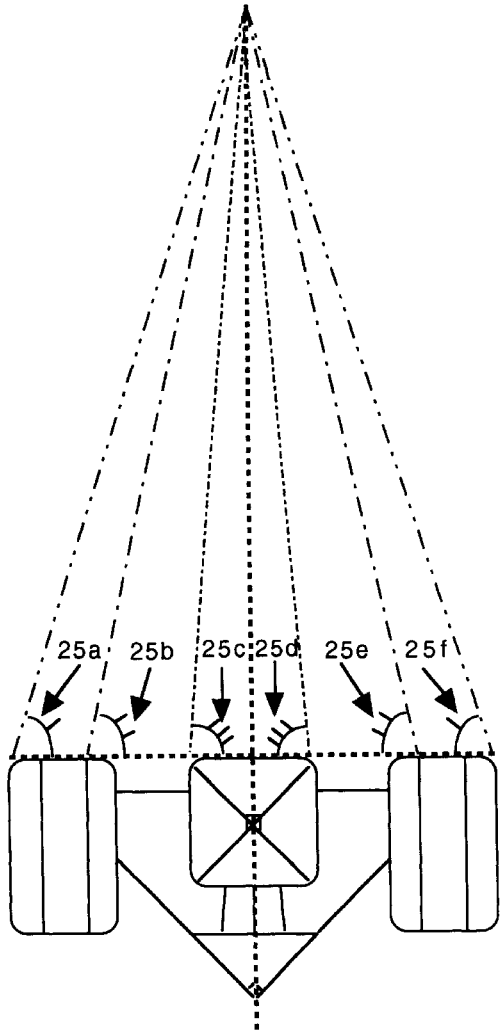
FIG. 7 is a detailing of the multiple, narrowing, triangulation angles, equivalent on both sides when the striking alignment is correct, creating stroke triangulation visualization.

A second approach to establishing triangular equivalence is to make two angles, and their connecting lines, equivalent. This approach starts like the first, by making the striking direction and the striking plane perpendicular, which it does by boxing in the striking direction (as in the prior art). This produces an equal, right angle on either side of the striking direction. The length along the strike line between the striking direction and each of any pair of points marking the near corner angles (say, to any of the potential pairs of parallel lines) is identical, as stated above. What becomes important, then, is enhancing the golfer's capability to make identical the same near comer angles, thereby making that pair of sighting triangles equivalent. (In FIG. 7, any of the pairs 25*a* and 25*f*, 25*b* and 25*e*, or 25*c* and 25*d*.)

Using this approach, when the near comer angles are identical, then the sighting triangles are identical—and the length of the strike vector is readily visualizable as the point of the intersection of the perspective lines formed by those near comer angles. Moreover, this approach guarantees that the strike vector will be a different length for each near comer angle; for it will be the denominator for the secant thereof, and the numerator is fixed. Neither the length of the strike vector nor the perspective line need be known or estimated ahead of time; the golfer need only consider the angles.

Figure 8:
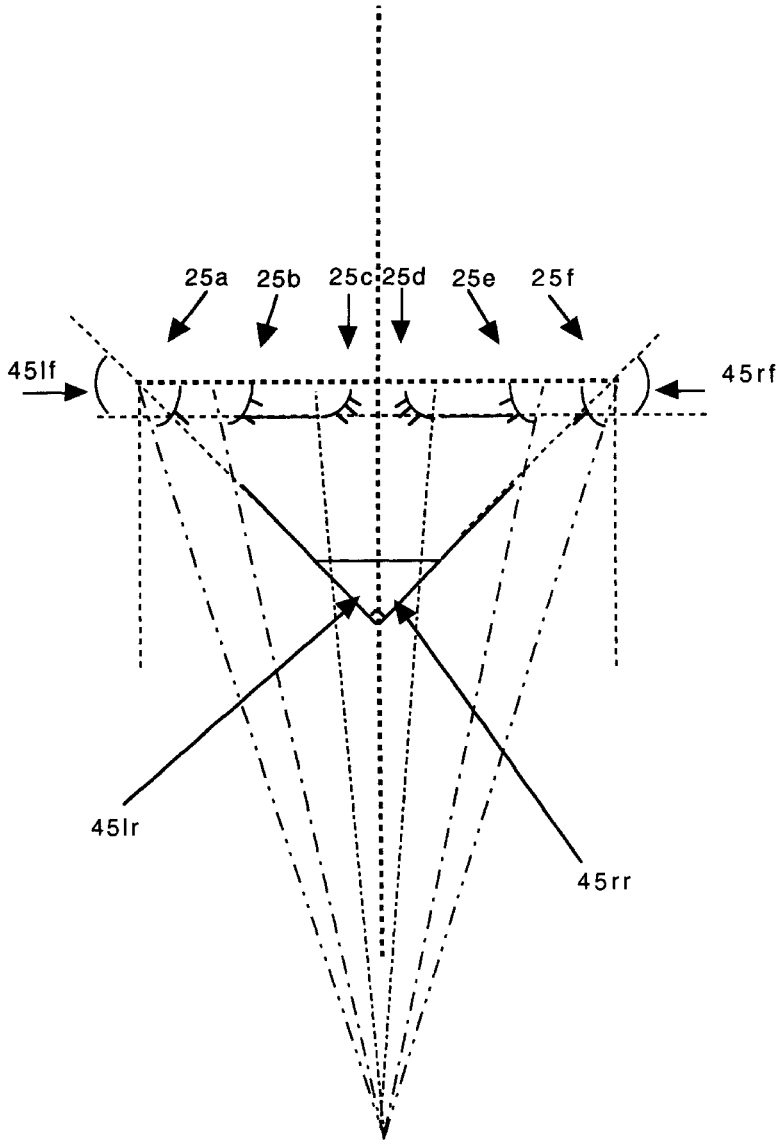
FIG. 8 is a detailing of the reflexive triangulation visualization.

Estimating and comparing angles is made easier by the preferred embodiment by the use of the culturally preferred 45° angle in the connection between the front and rear connectors for each stabilizer (FIG. 1; 10*lf* and 10*lr*; 10*rf* and 10*rr*.) The triangulation is reflexive, rear-to-front, as either the 45° angle intersecting the striking plane may be reflected forward of the striking plane (FIG. 8, 45*lf* and 45*rf*), or the sighting lines may be reflected backwards, to allow ready comparison. Moreover, a second 'check' estimate may be made with the 45° angle (45*lr* and 45*rr*) which can be seen on either side of the sighting line between it and the left and right rear sides of the rear element.

The reflexivity of the triangulation is further enhanced by incorporating, in the preferred embodiment, a trio of back link connections between the central striking element and the rear element (10*b*, left, center and front), where the center of the trio will align with the striking direction, as it points from the rearmost point of the rear element to the center of the central striking element, and where the left and right back link connections are equally separated from the center and angle outward, such that the whole suggest, reflexively, the forward visualization of the perspective sight lines.

Figure 9:
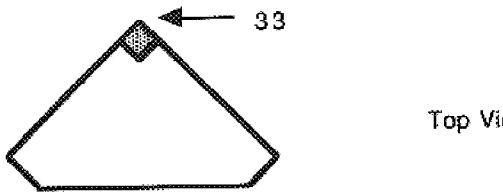
FIG. 9 details the rear element's visually differentiated aiming diamond and top cap construction thereof.
Figure 9:
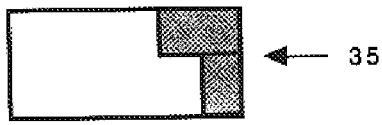

Additionally, in the preferred embodiment, in and on the top face of the rear element (FIG. 9) there is a visually differentiated aiming diamond (33), square in the X-Y dimension, offset by 90° to the central striking element and thereby 'square' to the rear element. In the preferred embodiment this aiming diamond is made of a different material than the rear element and forms the top part of a strengthening cap for manufacturability ease. (35.) The central tips of the aiming diamond will align with the center back link connection and the striking direction.

Further visualization and triangulation effects, comparisons, and reflexivity can be readily discerned by both laymen and those experienced in high-school trigonometry, and accordingly are not discussed further. The overall impact of the design of the preferred embodiment provides triangulation assists which are reflexive and intuitively perceptible, and balanced along both the X and Y axes if and only if the strike vector is aligned with the striking direction. These visualization aids support and guide the golfer's visualization during both the static and dynamic phases Stroke Power Estimation: The Model Supports Reality There is a subtle, yet important element of the design of the preferred embodiment which assists in stroke power estimation. The front face of the rear element, which is parallel to the striking face, has extending forward from it to the central striking element a trio of back link connectors, the center one of which is aligned with the strike vector and the left and right outer pair of which suggest a triangle that intersects along the strike vector. These act to produce and maintain an inner, reversed model of the central striking element, perspective lines, and forward vanishing and break point. Since this model remains constant over every putt, the golfer can readily visualize each putt as a deviation from that model, rather than as a completely unique event. Prior art does not provide such a constant visualization support. Since feedback depends upon contrasting observation, visualization, and support, the preferred form of the present invention enhances such feedback by providing a tool that allows the contrast.

Strike Alignment: The Moment of Inertia and Torque

A seemingly minor, yet significant, problem created by most putters in the prior art is omitted by the present invention. FIG. 10 shows this difference between a prior art putter (FIG. 10A) and the preferred embodiment of the present invention (FIG. 10B).

Most prior art putters (FIG. 10A) connect the shaft (31) to the head (33) near or at the heel of the head, putting the rotational axis of the putter (35) off-center from the rotational striking center of balance (37), making the putter rotationally unbalanced. When the shaft is laid across the palm of the hand (balanced end-to-end so the putter will not tip) with the striking face parallel to the ground, due to the effect of gravity on the putter head the striking face will fall to one side or the other, rotating the putter.

In the preferred embodiment of the present invention (FIG. 10B), the shaft (32) is connected to the putter head (34) such that the vector of the shaft (36) passes through the rotational striking center of balance for the putter as a whole (38). (Since most putter shafts are rotationally balanced, this connective vector will be at the rotational striking center of balance for the putter head; however, if the shaft is biased, the connection will be offset in the putter head in the appropriated direction such that the putter as a whole is rotationally balanced.) The affixation is by any conventional arrangement known in the art (including but not limited to: mechanical fixing, including but not limited to: screw and thread, and the like; permanent bonding, including but not limited to: welding, brazing, gluing, cementing, and the like; or the use of a hosel).

This precision attachment assures that the center line of the golfer's grip extends down to the center of the head's rotational center of balance. While the attachment is balanced in the Y axis, in the preferred embodiment the putter is imbalanced in the X axis with the greater mass in the head behind the attachment. When the shaft is laid across the palm of the hand (balanced end-to-end so the putter will not tip) with the striking face parallel to the ground, the striking face will not rotate but stay parallel to the ground. (It can, with care, be balanced face downwards, but will most readily and stably stay face upwards.)

Requiring this connective balance for the putter as a whole frees the golfer from having to exert a corrective force for such imbalance. With prior art putters the necessary corrective force constantly changes and require continuous corrections throughout each putt, unnecessarily complicating the golfer's task. It also has a subtler yet powerful effect, which is detailed further on when discussing feedback.

A fine point in the preferred embodiment is the differentiation between the theoretical striking face and the actual striking face; the latter is slightly inclined 'back' from the theoretical striking face, by 1° (one degree), to avoid imparting unwanted top-spin.

Previous putter designs have chiefly treated the putter head as a unitary mass. Some considered only the quantity (total weight); others, only the linear distribution relative to a single axis. To minimize rotation of the striking face, they increased the mass of the putter head; to maximize a dimension of the sweet spot, they increased the mass in that direction. Most importantly, in considering the design their inventors accepted the simplifying assumption that the entire putter head operated as if it had a uniform mass density, even when the materials and distribution of the components of the putter head varied. Doing so avoided considerable additional calculation in measuring and calculating the action of the head.

For example, calculating the moment of inertia for a three-dimensional object of mass m rotating on an axis theoretically requires solving the equation:

$$I = \lim_{\Delta m \to 0} \sum r^2 \Delta m = \int r^2 \Delta m, \qquad \text{EQ. 1}$$

where I is the moment of inertia; m is the total (unit) of mass of the object, Δm is the particular sub-element being considered, and r is the distance from the rotational axis to the particular sub-element of mass, that is, the inertial radius for that element.

EQ. 1, if we use the local volume density, that is, the mass per unit volume, becomes:

$$I = \int pr^2 dV \qquad \text{EQ.2}$$

where pdV has been substituted for Δm.

Presuming the body to be homogenous allows p to be treated as a constant, so that for putter heads moving along a rotational axis at the heel, EQ. 1 and EQ. 2 simplify to:

$$I_c = \frac{1}{3} m d^2 \qquad \text{EQ. 3}$$

where d is the total distance along the Y axis, that is, from heel to toe.

EQ. 3 is much simpler and easier to calculate, as all that needs to be considered is the total mass and the total length of the putter head from heel to toe. Changing the rotational axis along the Y plane merely changes the fraction (which reduces to a minimum of 1/12, for an axis in the rotational striking center of balance). But this presumption of homogeneity, or at least high symmetry, in the prior art obscured the potential gains that could be obtained by designs which deliberately differentiated mass distribution.

Figure 11:
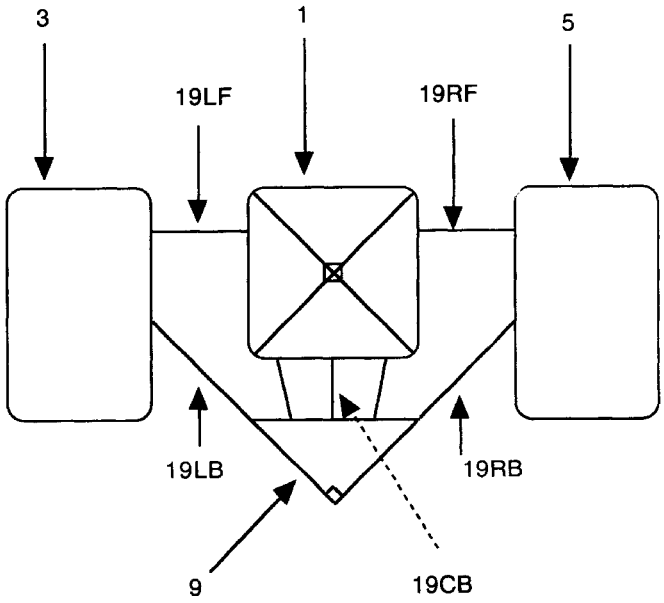
FIG. 11 is an expanded top view of the putter head design, showing the reflexive triangulation modeling aspect of the connecting links (19 LF, LB, RF, RB, and CB).

The first of these gains is, for any given mass distributed correctly, a greatly increased rotational stability, which minimizes the need to compensate for forces external to the putter's swing and grip (such as the impact with the golf ball, or accidental impact with the ground). Instead of presuming, or working towards, homogeneity of mass distribution, or even homogeneity along the Y axis, the preferred embodiment differentially distributes the mass of the putter head, with a particular ratio between the center and the ends of the Y axis, that is, between the central striking element on the one part, and the left and right stabilizers (the heel and toe) on the other. FIG. 11 is a an expanded view of the putter head of the preferred embodiment from FIG. 1, again seen from the top. The putter head comprises a central striking element (1), a pair of left forward connecting links (19LF), a left stabilizer (3), a left back connecting link (19LB), a rear element (9), a trio of center back connecting links (19CB), a right back connecting link, (19RB), a right stabilizer (5), and a right forward connecting link (19RF). In the preferred embodiment, masses of each of the stabilizers and the central striking element are in a 2:1 ratio and the mass of the connecting links and rear element are balanced along the Y axis, so that the mass distributed outward along the X axis is in a 4:1 ratio to the mass of the central striking element. (This ratio may range from 4:1 to 4.3 to 1, but no less and no greater; and the total mass for the preferred embodiment ranges between 1.6 and 1.8 pounds. In a further embodiment, the weight is adjustable through differentially weighted plugs for the stabilizers.) The central striking element is attached to the shaft (32) as shown in FIG. 10B.

Distributing the mass outward along the X axis reduces the rotation of the putter head from an off-center force (e.g., should the central striking element impact the center of mass of the golf ball other than where the rotational striking center of balance is passing along the striking vector), through the effect of the conservation of angular momentum.

When striking a golf ball, the shaft of the putter forms an axis around which the head may rotate. For any given mass which is pivoted about some axis, when a force is exerted on that mass which does not pass through that axis, the mass will tend to rotate about that axis. This tendency is measured by torque ($\tau$). The magnitude of the torque is defined for a given force F by the expression:

$$\tau = rF \sin \phi = Fd \qquad \text{EQ.4}$$

where d is the moment arm, or lever arm, of the force F, and is further defined by:

$$d = r \sin \phi \qquad \text{EQ.5}$$

In both EQ.4 and 5, $\phi$ is defined as the angle between the vector of the force F, and the vector drawn from the rotational center of balance to the intersection of the striking plane and the vector of the force F.

Torque is not the same as force; for torque's basic units are measured in force times length. The length (d) is the distance not from the rotational center of balance along the strike plane to the intersection of the vector of force F, but is shorter, for it is the distance along a vector from the rotational striking center of balance which is perpendicular to the vector of the force F from the rotational striking center of balance to the intersection with the vector of force F. What is important is that $\tau$ increases proportionally to d, or, in common-sense terms, that the lever arm grows proportionally stronger as it grows longer.

Gammil identified some of the importance of outwardly distributing the mass of the putter head, and of aligning the rotational axis of the putter with the striking vector. However, Gammil preferentially treats the putter effectively as a hoop or hollow cylinder in that in his invention the distribution is equivalent along both the X and Y axes, and the shaft aligns precisely with the rotational center of the putter head.

However, Gammil failed to realize the importance of minimizing the possible moment arm, or d factor, that is, the distance which a golf ball can be struck off the rotational striking center of balance. The entire front face of Gammil's putter, wider than the mass distributing elements, can be used to strike the golf ball. In play, for close-in or easy shots, many golfers simply tap the ball with any part of the strike face—and then wonder why that putt went fractionally awry, as off-center torque causes a minute deviation from the striking direction and ruins their striking alignment.

The preferred form of the present invention avoids this by limiting the extent of the central striking element. It is large enough to allow the golfer to feel assured of making a fair hit, but small enough to require them to focus on the stroke. Preferentially, the width of the striking face is one and a half times the width of the golf ball, which will leave a quarter-width on either side for a dead-center strike. The total width of the central striking element is less than the width between Gammil's sighting bars, so the potential width for an off-center shot is far less than that possible using Gammil's putter, which sharply constrains the possible moment arm, thus the d factor, and thus the torque, thereby greatly aiding striking alignment.

Moreover, by differentiating the mass distribution, the preferred form of the present invention maximizes the potential difference attainable between the moment of inertia and the torque. The stability of the putter head grows with the square of the radius of distribution from the center (r, in EQ. 1 and 2), not linearly with the distance from the rotational axis (d, in EQ. 3–5). This differential, outward distribution is particularly effective because the power of an off-center strike can only increase linearly (with d), while the resistance (or moment of inertia) increases with the square of r. This amplifies the effect whereby d is a fractional, lesser component of r, as shown in EQ. 4 and 5. It also plays a significant part in the feedback, as detailed below.

The preferred embodiment of the present invention deliberately distributes the mass of the putter head outward from the rotational center of balance. Additional stability is given by the back triangulation element, with a separate inertial radius which also dampens any offset. In the preferred embodiment, this dampening effect is increased by putting the center of gravity of the putter as a whole behind the rotational center of balance, which maximizes the offsetting effect of the triangulation element.

EQ. 1 indicates why the distribution of the mass of the putter head, and the use of stabilizers and triangulation element, so enhances the putter head's rotational stability. The more mass that is farther from the rotational striking center of balance, the higher the moment of inertia. By placing four-fifths of the mass on the rotational center of balance as far out along the Y axis as possible, and placing additional mass along the striking vector but out from the rotational center of balance, the preferred form of the present embodiment of the invention maximizes the moment of inertia for the putter head as a whole, and thus reduces the effect of an off-center strike.

This effect can be comprehended through a simple example. If the strike plane is treated as a seesaw, the rotational striking center of balance forms the axis of the seesaw. Most putters, and most seesaws, have the mass equally distributed along the Y axis, or the length of the seesaw. If the golf ball is nephew Tom, he will not disturb the seesaw when he jumps onto the center; but if Tom jumps onto either side of the seesaw, he will cause it to turn (probably tumbling Tom off, just as the off-center strike will send the golf ball elsewhere than along the striking vector).

One way to stabilize the seesaw for Tom is to add more mass to it—Uncles Fred and Harvey. However, if Uncles Fred and Harvey are not evenly balanced on the seesaw, something has to hold it level! (For the putter, this would be the golfer's grip on the shaft, while for the seesaw, it probably is an uncle's legs.) Now when nephew Tom jumps on the seesaw, it is moves less, as Tom must move the mass of the seesaw and Uncles.

But presume the mass stays constant (i.e. that the Uncles had already been added to the seesaw). The present invention insists that they sit at the ends of the seesaw, not towards the middle, that is, away from the rotational center of balance. Even though Tom will always be jumping closer to one Uncle, he will be jumping farther away from the other—and the distance between the far uncle and the rotational center of balance is far more stabilizing than the distance between Tom and the rotational center of balance.

A second commonsense observation confirms the analogy and the fundamental value of the preferred embodiment's implementation: when a tightrope walker wants to maximize his balance, he uses a balancing beam which has weights at the end for exactly the same reason: to maximize the moment of inertia and lessen the influence of rotational forces.

Feedback, Resonance Sweet Spot Depth, and Stroking Alignment

Torque is not the only aspect of physics which affects a golf putter, and thus a putt. There are other forces acting on all putters during their stroke—the motion made by the golfer, gravity, and the impact with the golf ball—the former two of which can also induce torque. While torque resulting from the impact with the golf ball, or occurring during stroking alignment, may worsen a stroke, increasing torque may improve a golfer's stroke, when doing so can provide feedback that allows him to correct a stroke before the putter strikes the ball.

The resistance of a putter to an offsetting torque depends upon three factors. The first two are the strength of the golfer's grip and responsiveness of the putter. Too strong a grip can induce tremors which will cause inadvertent rotation, and can mask the feel of the putter; too loose a grip will not provide sufficient frictional support to correct any external offsetting force, letting the putter turn in the golfer's hands. The third factor, the responsiveness of the putter, can enhance the golfer's ability to sense when his putt needs correction, which is especially critical before the head strikes the golf ball. Because if a putt is about to go awry, the golfer can correct the error or stop the stroke.

Integrating experience with intention (i.e. learning where to orient the initial striking vector, how much power to put into a putt, and how to swing the putter to generate the desired power) is affected by the quality of the feedback, visual and kinesthetic, provided by the putter. The less that a given putter interferes with the golfer's intention, i.e. the more that it enhances any corrective grip, or proper swing during use, the faster and easier is such integrative learning. The preferred form of the present invention provides significant kinesthetic feedback by having a portion of its weight distributionally offset to the rear, precisely in order to help keep the user's stroke straight throughout the putt, a crucial factor in putting accuracy.

During the backswing, the rear-biased moment of inertia and weight offset from the rotational striking center of balance along the X-axis of the preferred embodiment of the present invention enhances any deviation along the Y-axis induced by the golfer's grip, swing, or motion of the club, as that distribution of the putter's mass deliberately increases both r and d along the X-axis (increasing the lever arm). The golfer is more likely to perceive, and thereby have the opportunity to correct or prevent, such deviation before the ball is struck, which greatly enhances both striking and stroking alignment.

Figure 12:
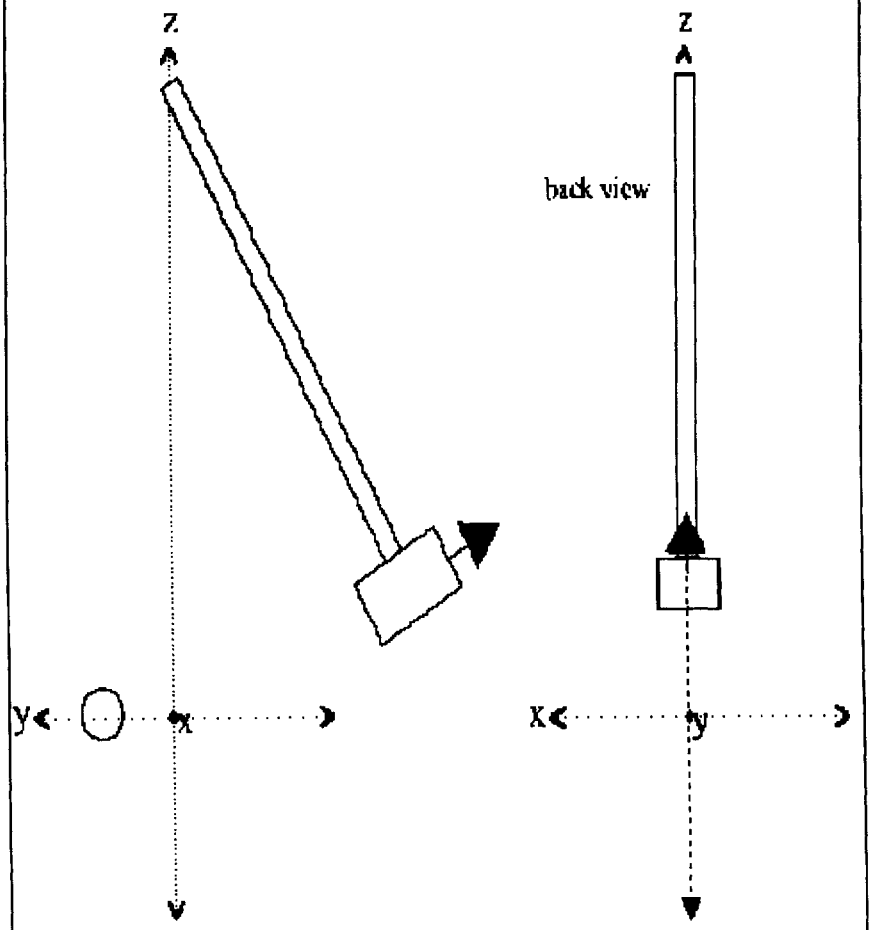
FIGS. 12 through 16 are snapshots of the putter during the swing, showing the dynamic forces acting on the putter head.

Since the mass of the putter stays identical from putt to putt, the golfer's ability to sense, correct, and eventually avoid such deviations is enhanced by this induced and deliberate dynamic instability. This approach is both novel and unique, as it enhances kinesthetic feedback dynamically. FIG. 12 shows the putter at the moment of contact with the ball, in a side view. The X-axis runs through the contact point along the face of the putter (perpendicular to the paper), the Y-axis runs through the contact point in the plane of the paper along the direction of the swing, and the Z-axis runs along the handle of the putter. The rear element is shown in black. The goal of the user is to swing the putter completely in the Y-Z plane, making contact with the ball at the origin, and following through while keeping the putter completely in the Y-Z plane.

Figure 13:
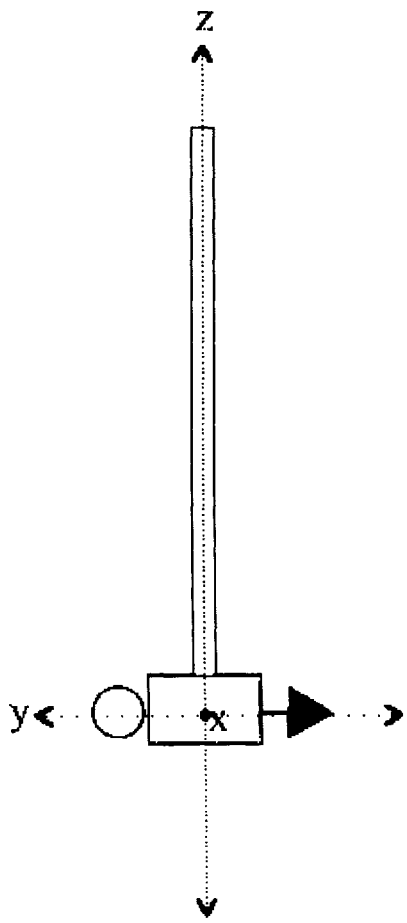

FIG. 13 shows the putter during the backswing, in side and back views, during a correct swing. Note that the rear element remains in the Y-Z plane in line with the swing. Because the swing is circular, the rear element is now above the main body of the putter, putting it in an unstable equilibrium.

Figure 14:
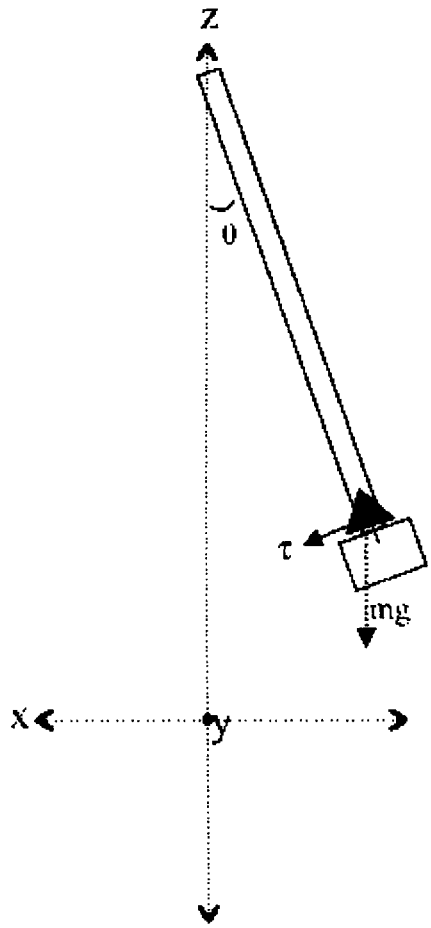

FIG. 14 shows a back view of the putter during the backswing, if the user inadvertently twists the handle of the putter (a very common mistake). There are two possible twists: a rotation around the handle, or a rotation around the point where the putter is held. While the following analysis applies to both twists, only the second is depicted here, and the amount of the twist is exaggerated for clarity. The rear element is now off its intended location in the Y-Z plane. Its weight (mg) exerts a torque ($\tau$=mg sin $\theta$; essentially, EQ. 4) along the handle of the putter, tending to increase the incorrect rotation. This torque provides the golfer with feedback, which encourages him to automatically correct his stroke. Most users pay close attention to their backstroke; the feedback provided by the rear element directs the user to straighten his stroke both through automatic proprioceptive mechanisms, as well as by making the user consciously aware of what would otherwise be imperceptibly small errors in his stroke.

Figure 15:
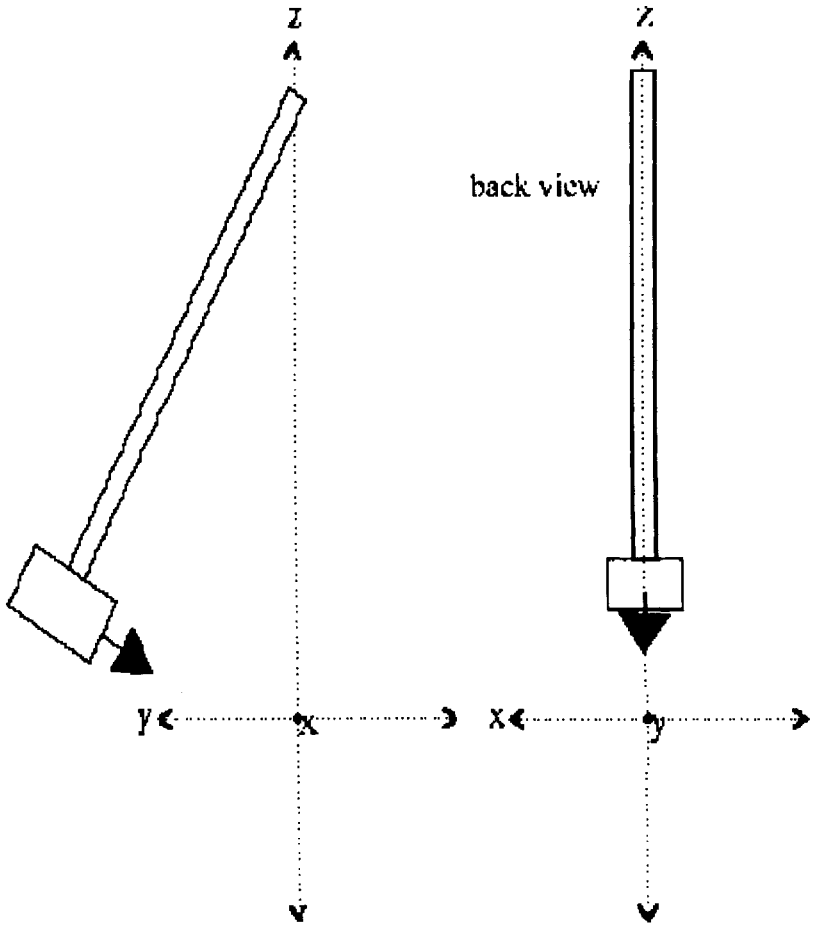

FIG. 15 shows the putter during the follow-through, in side and back views, during a correct swing. Again, note that the rear element remains in the Y-Z plane, in line with the swing. Because the swing is circular, the rear element is now below the main body of the putter, putting it in a stable equilibrium.

Figure 16:
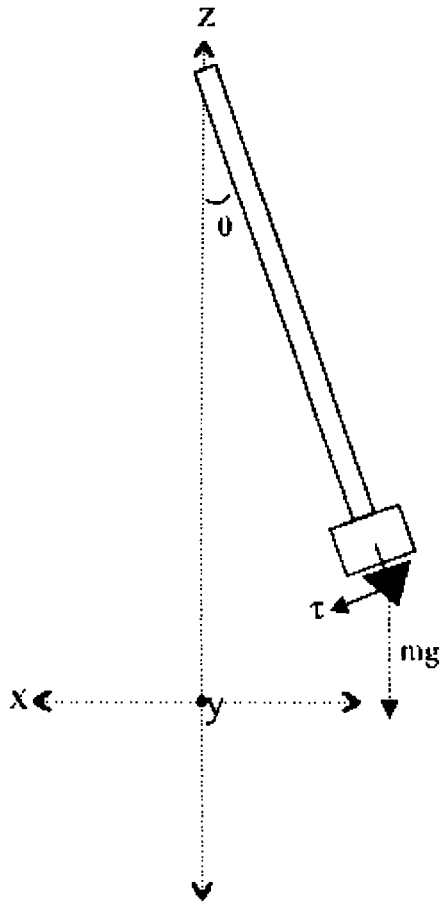

FIG. 16 shows a back view of the putter during the follow-through, if the user inadvertently twists the handle of the putter (again, a very common mistake). The rear element is again off its intended location in the Y-Z plane. This time, the torque it exerts along the handle of the putter tends to restore the correct orientation. Many users pay less attention to their positioning during the follow-through phase of the stroke, so the automatic correction provided by the putter is particularly useful. Over time, the user's sense of proprioception is trained in the correct stroke, improving his accuracy even with traditional putters.

At the moment that the putter strikes the golf ball, there is an energy exchange, as the kinetic energy of the moving putter head is transferred to the golf ball. The sensitivity and reactivity of the putter depends on how that resonates through the putter head to the shaft and thence to the golfer. Some putters are built with little feel. Some are too sensitive, or too fragile, so the putter head deforms under repeated use, wearing out unacceptably quickly. The present invention is designed to optimize the resonance of that energy transfer and thereby increase both the feedback experienced by the golfer and the durability of the putter head.

At the moment of impact, the mass distribution of the left and right stabilizers ensures that the head transmits the impact energy chiefly to the sides, through the forward connecting links. The cylindrical shape and solid mass of the stabilizer then shapes and reflects the force from the impact backwards through the stabilizer to the rear connecting link, which then transmits the energy to the rear element. The rear element then merges the transmitted force from the left and right stabilizers and, through its angled sides and the shorter back connecting links, bounces the energy back forward to the central striking element. If the strike is off-center, the difference in reflection time will be felt. This vibrative differential means that the golfer gets feedback on any off-center shot that is independent of any (lesser) degree of experienced torquing of the striking plane.

The angle and placement of the connecting links (side, back, and rearward) act to create an 'anchor point' which provides ready reflection and transmission of the impact energy. The preferred embodiment uses a design that is, in miniature, like that used in the earliest all-metal bridges of Isambard Brunel, a design that was meant to transmit and reflect, rather than absorb and disperse, impact energy. By reflecting and dissipating the shock of impact the shock of impact is shared by the entire putter, decreasing the wear on the central striking element or any other particular, single portion thereof.

The present invention maximizes, for any particular mass in a putter head, that putter's rotational stability and resonance, thereby meeting the goals of the first paragraph, by a design which accurately implements the effects of the forces acting upon the putter head throughout the stroke, from the initial setting through the backswing, the moment of impact, and the follow-through. The design enhances the interaction of these forces with both the 'human factors' of a golfer's visualization and kinesthetic sensing and the internal force transmission within the putter of the impact with the golf ball during the stroke. The putter head uses a non-homogeneous, yet balanced, mass density and distribution for several beneficial effects on each particular putt and the continued putting by the same golfer.

The combination of mass-distribution, resonance and rearward meta-stability interact with the deliberately narrowed focus provided by the isolated central striking element to create a sweet spot that appears to be completely coincident with the central striking element in width, that extends back to and nearly beyond the rear element in depth. The center of the putter, where the golfer focuses his swing and the impact, resonates and guides his strokes in a consistent and perceptibly stable fashion. Combined with the feedback visualization provided by the design, the overall effect is to provide a putter whose sweet spot seems broader, and deeper, than the part of the putter which is meant to strike the ball, which increases the confidence and refines the focus on the continued stroke, thereby enhancing stroking alignment.

This enhancement of stroking alignment is further supported by three subtle yet important elements of the design of the preferred embodiment. One of the ways that a putter can mar his after-impact putt is to clip the ground with the trailing portion of the putter. The deeper a putter, the more likely this can come into play. By building in a 1° inclination on the Z axis, along the Y axis, of the bottom face of the stabilizers, the chance of such an impact is reduced. And the entirety of the rear element, and the rearward link connectors linking it to both stabilizers and the central striking element, are above the bottom of the stabilizers and the central striking element. That way, even if the golfer should tip the club head imperceptibly during the follow-through stroke (perhaps as a consequence of a common mistake, lifting the head to view the putt and dropping the rear shoulder fractionally when doing so), the putter head will either not make contact with the ground, or will do so with a minimal, and glancing, impact.

The preferred embodiment embodies some fine details of construction, specified further herein: the central striking element is no more than one and a half times the width of the golf ball, and is a quarter-inch under the height, with a sixteenth-inch arc across the top, all of which subtly supports the focus, resonance, and striking alignment of the putt. The stabilizer's width is, to a golf ball's, in a 5:8 ratio, and the stabilizers are hexagonal in form (or at least rectangular) with the top face parallel to the ground plane and the link connectors attached through the hex angle line, rather than through a hex face, and individually equally weighted front-to-back. If the link connectors are assembled to the other elements they are connected within a $1/1{,}000$" (one one-thousandth inch) tolerance for each subset (link connectors from a stabilizer, or between the central striking element and the rear element). And there is a line on top of the central striking element directly along the striking direction perpendicular to and at the center of the X axis.

While this invention has been described in reference to illustrative embodiments, this description is not to be construed in a limiting sense. Various modifications and combinations of the illustrative embodiments as well as other embodiments of the invention will be apparent to those skilled in the art upon referencing this disclosure. It is therefore intended this disclosure encompass any such modifications or embodiments.

I claim:

1. A golf putter head connected to the shaft of the putter such that the vector of the shaft through the golf putter head passes through the rotational striking center of balance for the putter as a whole, wherein said head comprises:

a central striking element with a front striking face and top, bottom, left, right, and rear aspects;

one or more sub-elements distributing the mass evenly along the Y axis outward from the central X axis, said sub-elements comprising:

a left stabilizer, a right stabilizer, and, a rear element;

wherein the majority of the mass of the head is distributed behind the connecting vector with the shaft; and, resonance transmitting, alignment visualization, and triangulation-supportive connecting means for connecting said sub-elements together with each other and with said central striking element.

2. A golf putter head as in claim 1, further comprising:

linear pattern guides for alignment with the striking direction on the central striking element.

3. A golf putter head as in claim 2, further comprising:

a center back connecting link with a front and back end, said front end connecting to the rear aspect of said central striking element and said rear end connecting to said rear element, whose line is identical to the striking direction;

a left back connecting link with a front and back end, said front end connecting to the rear aspect of said central striking element and said rear end connecting to said rear element, whose line is angled towards the left stabilizer;

a right back connecting link with a front and back end, said front end connecting to the rear aspect of said central striking element and said rear end connecting to said rear element, whose line is angled towards the right stabilizer;

wherein the center back connecting link attaches near the top of the rear element and the top of the center striking element, and the right and left rear connecting links attach near the bottom of the rear element and below the half-way height of the center striking element.

4. A golf putter head as in claim 1, wherein the mass of said stabilizers and central striking element have a ratio between 4.3:1 and 4:1, and the mass of the left and right stabilizers have a ratio of 1:1.

5. A golf putter head as in claim 4 wherein:

said left and right stabilizers are regular, angled solids with at least four faces, with the bottom face parallel to the X axis.

6. A golf putter head as in claim 5, wherein said left and right stabilizers are hexagonal solids with the top face parallel to the X-Y plane and the bottom face parallel to the X axis but angled one degree away from the Y axis, upward towards the rear.

7. A golf putter head as in claim 1, wherein said connecting means comprise:

a pair of left front connecting links with left and right ends, each right end being connected to the left aspect of said central striking element and each left end being connected to said left stabilizer near the front thereof, with each left front connecting link being parallel to the X axis;

a pair of right front connecting links with left and right ends, each left end being connected to the right aspect of said central striking element and each right end being connected to said right stabilizer near the front thereof, with each right front connecting link being parallel to the X axis;

a left rear connecting link with left and right ends, the left end being connected to the right side of said left stabilizer at a rearward angle of 45 degrees to the X axis and the right end being connected to the rear element;

a right rear connecting link with left and right ends, the right end being connected to the left side of said right stabilizer at a rearward angle of 45 degrees to the X axis and the left end being connected to the rear element;

said left and right rear connecting links being so connected to the respective stabilizers that if extended they would join at a 90 degree angle at the rearmost point of the rear connecting element;

said left and right rear connecting links connecting to said rear element at the non-right front angles of said rear element; and, at least one back connecting link with a front and back end, said front end connecting to the rear aspect of said central striking element and said rear end connecting to said rear element, such that there is always a central back connecting link whose line is identical to the striking direction.

8. A golf putter head as in claim 1, wherein said rear element is triangular in shape with a right angle whose point faces rearward, that further comprises:

a visually differentiated aiming diamond, square in the X-Y dimension, offset by 90° to the central striking element and thereby 'square' to the rear element's rearmost point and right angle, made of a different material than the rear element, whose tips align with the center back connecting link and striking direction, said diamond further forming an inset top cap for manufacturability ease.

9. A golf puffer head as in claim 8, wherein said triangular rear element is connected to said left and right rear connecting links which connect to said triangular rear element at the non-right angles thereof.

10. A golf puffer head as in claim 9, wherein said triangular rear element has the non-right angles truncated so as to form a face parallel to the end of the connecting link from the stabilizer to enable ready assembly.

11. A putter as in claim 1, further incorporating a 1 degree inclination backwards from the theoretical striking plane in the front striking face of the central striking element.

12. A puffer as in claim 11, further comprising a top curve on said top aspect of said central striking element, wherein the total height of said central striking element is in a 5/6 ratio to the height of a golf ball, and the height of said top curve does not exceed one-twentieth of the total height of said central striking element.

13. A golf putter head connected to the shaft of the putter such that the connecting vector of the shaft through the golf putter head passes through the rotational striking center of balance for the putter as a whole, with sub-elements thereof further comprising a central striking element having a front face and top, bottom, left, right, and rear aspects, left and right stabilizers, a rear element, and connecting means joining said central striking element to said left and right stabilizers and to said rear element, and said rear element to said left and right stabilizers, wherein said head further comprises:

strike alignment means;

provision of 90 degree (right) and 45 degree angles in the head's sub-elements and connections thereof, said angles being measurable against both the X and Y axes and providing reflexive triangulation visualization; striking alignment means; and, stroking alignment means.

14. A putter as in claim 13, wherein said striking alignment means comprise:

differentiation of a central striking element whose extent along the Y axis measures no more than one and a half times the width of golf ball, whose mass comprises no less than one half and no more than 1/2.15 of that of a sideward stabilization component; and, inclusion of elements that are both identical to and parallel to the striking vector in other portions of said putter head.

15. A putter as in claim 13, wherein said stroking alignment means comprise:

connection of a rear element to said central striking face such that both the connecting means and the bottom of said rear element are raised well above the bottom aspect of said central striking element;

distributing the majority of the mass of the head behind the connecting vector with the shaft; and, angling of the bottom face of said stabilizers at one degree upwards towards the rear.

16. A golf putter head connected to the shaft of the puffer such that the vector of the shaft through the golf puffer head passes through the rotational striking center of balance for the puffer as a whole, wherein said head comprises:

a central striking element having a front striking face, left, right, top, bottom, and rear aspects, being no more than one and a half times as wide as a golf ball, being no more than five sixths as tall as the average golf ball, wherein the front striking face inclines rearward up to 1 degree, the top aspect curves to a central height no more than one-sixteenth of an inch greater than the sides, with at least one linear alignment design element on said top aspect along the X axis through the center from rear to front of said central striking element;

a pair of left connecting links with left and right ends, the right ends being connected to the left aspect of said central striking element above each other, said connecting links being parallel to the Y axis;

a left stabilizer, in the form of a hexagonal cylinder extending along the X axis, with the top face parallel to the X-Y plane and the bottom face inclined one degree upwards towards the rear, connected to said left ends of said left connecting links at the rightmost angle of said hexagonal form, substantially towards the front, the mass of said stabilizer ranging from a ratio of 2 to 2.15 to 1 when compared to said central striking element;

a left rear connecting link with left and right ends, said left end being connected to said left stabilizer at a 45 degree rearward angle to said left front connecting links and the X axis and at the rightmost angle of said hexagonal form;

a pair of right connecting links with left and right ends, the left ends being connected to the right aspect of said central striking element above each other, said connecting links being parallel to the Y axis;

a right stabilizer, in the form of a hexagonal cylinder extending along the X axis, with the top face parallel to the X-Y plane and the bottom face inclined one degree upwards towards the rear, connected to said right ends of said right connecting links at the leftmost angle of said hexagonal form, substantially towards the front of the mass of said stabilizer ranging from a ratio of 2 to 2.15 to 1 when compared to said central striking element;

a right rear connecting link with left and right ends, said right end being connected to said right stabilizer at a 45 degree rearward angle to said right front connecting links and the X axis and at the leftmost angle of said hexagonal form;

a triangular rear element with a right angle pointing rearward, a front face, a visually differentiated aiming diamond, square in the X-Y dimension, offset by 90° to the central striking element and thereby 'square' to the rear element's rearmost point and right angle, made of a different material than the rear element, said aiming diamond's tips aligning with the center back connecting link and striking direction, said aiming diamond further forming an inset top cap for manufacturability ease, with said triangular rear element connecting to said left and right rear connecting links at the other angles of said rear element;

with the mass of the putter head totaling between 1.6 and 1.8 pounds and balanced along the Y axis behind the shaft vector;

a trio of back connecting links, each back connecting link having front and rear ends, said front end connecting to the rear aspect of said central striking element, said rear end connecting to the front hypotenuse of said rear element, with a central rear connecting link aligned with the striking vector and connected near the top of each of the central striking element and rear element, the left connecting link connected near the bottom of the rear element and to the bottom half of the central striking element and angled outward frontally towards the left stabilizer, the right connecting link connected near the bottom of the rear element and to the bottom half of the central striking element and angled outward frontally towards the right stabilizer; and, all link connectors are assembled within a $1/1{,}000$" tolerance for each subset, link connectors from a stabilizer, or between the central striking element and the rear element, and braized together once assembled.

* * * * *